United States Patent [19]

Bennett

[11] 3,998,461

[45] Dec. 21, 1976

[54] ARCHERY PROJECTOR AND TARGET

[76] Inventor: William G. Bennett, P.O. Box 393, Slidell, La. 70458

[22] Filed: Sept. 26, 1975

[21] Appl. No.: 617,093

[52] U.S. Cl. ..... 273/101; 124/22; 273/102 B

[51] Int. Cl.[2] ..... A63B 71/02

[58] Field of Search ..... 124/22; 273/101, 102 B, 273/102 S, 106.5 R, DIG. 2

[56] References Cited

UNITED STATES PATENTS

| | | | |
|---|---|---|---|
| 273,510 | 3/1883 | Goldes | 273/101 |
| 509,601 | 11/1893 | Kelly | 273/101 |
| 516,852 | 3/1894 | Trumble | 124/22 |
| 2,335,393 | 11/1943 | Lubicz | 273/102 S |
| 2,608,188 | 8/1952 | Howard | 124/22 |
| 3,138,382 | 6/1964 | Barker | 273/102 B |
| 3,396,971 | 8/1968 | Estep | 273/102 B |
| 3,610,623 | 10/1971 | Ferrer | 273/101 |

*Primary Examiner*—Richard C. Pinkham
*Assistant Examiner*—Marvin Siskind
*Attorney, Agent, or Firm*—Pugh & Keaty

[57] ABSTRACT

A missile and target toy which allows horizontal and vertical manipulation of the path of a missile or arrow and at the same time providing a stationary base from which the arrow is propelled, which allows one handed loading, aiming and firing of a missile. The stationary base comprises an H-shaped structure with an open lateral support bar for the missile and is mounted on and into the ground.

3 Claims, 3 Drawing Figures

ARCHERY PROJECTOR AND TARGET

BACKGROUND OF THE INVENTION

1. Field of the Invention

The instant invention relates to a missile and target toy, in which the loading, aiming and firing operation can be achieved one-handedly, and more particularly to a stationary missile propelling means allowing vertical as well as horizontal change in the path of the arrow via a one handed operation.

2. Prior Art

Propelling an arrow or other missile is a relatively old operation. Examples of the more developed methods are the crossbow and the longbow. Of general background interest to the present invention are the following U.S. Pat. Nos.: 516,852, 3,138,149 and 3,752,311. The use of a hand-held means to propel a arrow or other missile is described in U.S. Pat. No. 516,852, which involves a hand-held missile propelling means with a loop for restricting the angle of the missile.

The use of a stationary means to propell a missile is known and described in U.S. Pat. No. 3,138,149 pertaining to a ground mounted bait launcher.

U.S. Pat. No. 3,752,311 is merely further exemplary of typical prior art archery systems.

As will be seen in the description of the preferred embodiment, the present invention, not only provides a stationary propelling means but also permits unrestricted horizontal and vertical path selection for the propelled missile.

GENERAL DISCUSSION OF THE INVENTION

The preferred embodiment of the present invention comprises a H-shaped stationary missile propelling device and an H-shaped target support, a target and a missile. The H-shaped stationary missile propelling means provides an unlimited selection of horizontal and vertical paths for the missile while at the same time providing a stationary base on which the propelling means may be positioned and supported. The present invention eliminates the use of a bow or other stress beam by use of an elastic means for propulsion. Although this may at first glance seem similar to the common sling shot, the interaction of the elastic propulsion device and the stationary lateral bar discloses a combination non-existing in the prior art. The present invention provides a stationary lateral bar upon which the missile rests prior to release for firing. The bar is free of any restrictions, such as loops, hooks, notches or the like that are usually provided to restrict the placement of the missile on the bar. The missile can be laterally and horizontally pivoted on the lateral bar as desired to select the path of the missile.

The elastic means is attached to the stationary frame supporting the lateral bar so as to engage the notched end of the missile or arrow. The stationary frame is attached to the ground by the pointed ends of the structure or by other attachment means to the floor or other level or unlevel surfaces. Upon retraction of the missile engaged to the elastic member, the lateral bar remains stationary without manual assistance. This of course allows for simple operation of the propelling mechanism and thereby allows for ease of operation without the restrictions of horizontal or vertical path selection. For example an operator need only use one hand to load, aim and fire the present invention.

It is an object of the present invention to provide a stationary propelling means capable of a change in the horizontal and vertical path of the missile.

Additionally it is the object of the present invention to provide a stationary target position so as to allow the missile fired by the stationary propelling means to strike and penetrate the target assuming that the correct path has been chosen by the operator.

A further object of the present invention is to provide a simple one hand method for loading, aiming and firing a missile without restrictions of the horizontal or vertical path of the arrow.

BRIEF DESCRIPTION OF THE DRAWING

For a better understanding of the nature and objects of the invention, reference should be had to the following detailed description, taken in conjunction with the accompanying drawings in which like parts are given like reference numerals and wherein.

DESCRIPTION OF THE PREFERRED EMBODIMENT

The present invention comprises a missile support and propelling means 1, a target and target support 7 and a missile 15.

Figure 1:
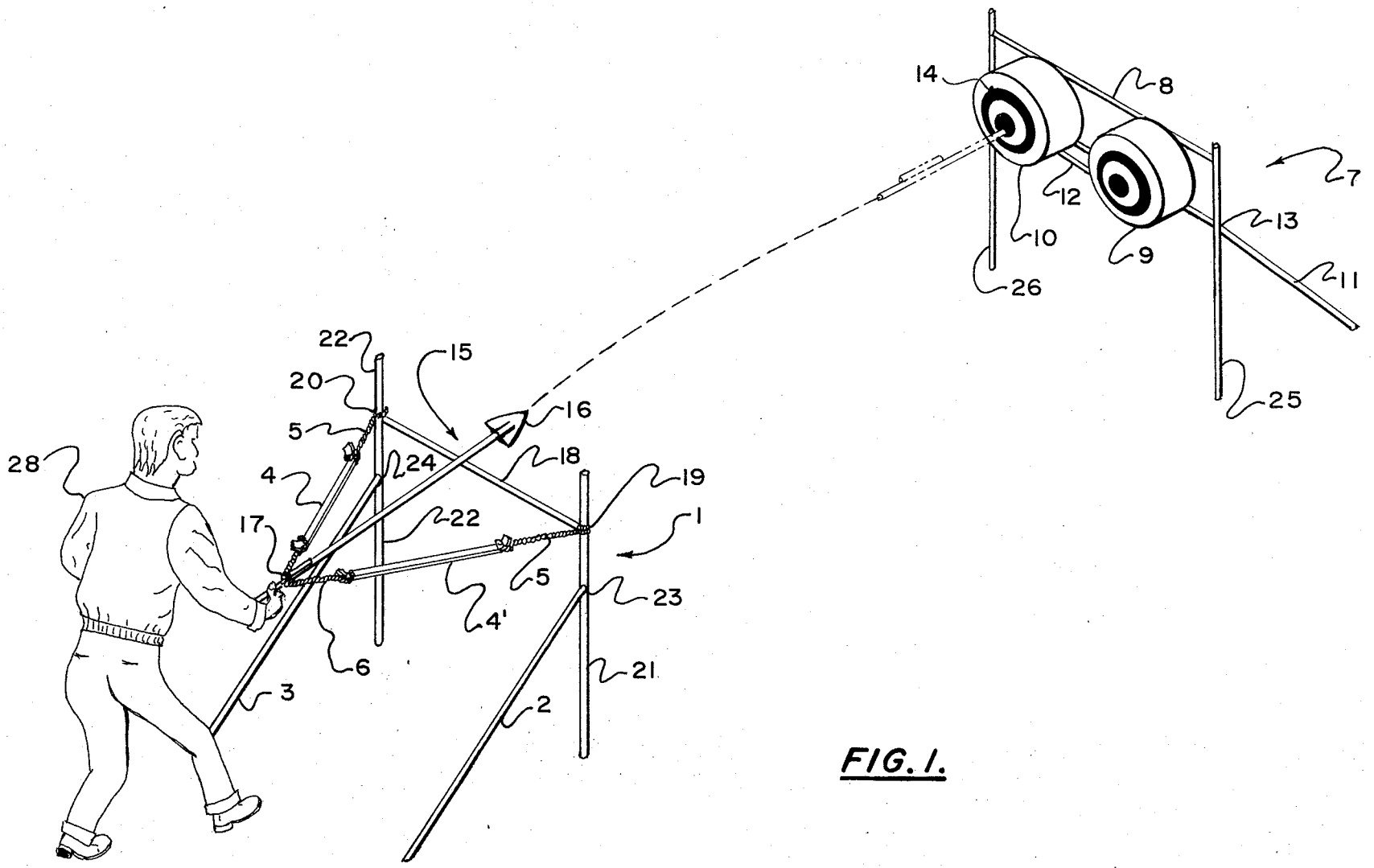
FIG. 1 is an overall perspective view illustrating the missile support and propelling mechanism as well as the target support mechanism.

As illustrated in FIG. 1, the missile support and propelling means 1 consist of an H-shaped structure constructed of two vertical arms 21 and 22 and a horizontal member 18, said horizontal member being connected to said vertical members 21 and 22 respectively at the points 19 and 20. The H-shaped member 1 is held in a vertical position by angle support members 2 and 3 respectively. Angle support members 2 and 3 are attached to the vertical side members 21 and 22 respectively of the H-shaped structure 1 at or about the mid-points 23 and 24 respectively of the vertical sides. The angle support members 2 and 3 are positioned so as to provide support for the H-shaped structure 1 during the propulsion step as will be explained below in operation of the subject invention.

Attached at the extreme ends of the horizontal member 18 are an elastic members 4 and 4' respectively. The elastic members 4 and 4' in the preferred embodiment of the present invention are strips of rubber, however any elastic means could be employed, for example springs. The elastic members 4 and 4' are attached at their respective ends of horizontal member 18 by small diameter fiber ropes 5 and 5' respectively. It should be noted that any method of attaching said elastic members 4 and 4' is sufficient. The use of small diameter fiber rope is only an example of the preferred method of attaching said elastic members 4 and 4'. The other ends of the elastic members 4 and 4' respectively are attached to each other by a small diameter fiber rope 6. The small diameter fiber rope 6 will be placed in the notched end of the missile 15 as will be explained in the operation below.

The target support 7 comprises an H-shaped structure including dual, parallel cross members, an upper one 8 and a lower one (unnumbered). The horizontally disposed cross members are supported by two vertical supports 25 and 26 to complete the general H shape of the structure.

Targets 9 and 10 are of cylindrical shape and are attached to the H-shaped structure 7 and the horizontal cross members. The targets 9 and 10 are shallow cylinders, the center line of which is positioned parallel to the path of the missile. The depth of the targets as well as the diameter of the targets can be varied depending on the type and length of missile used. In the present embodiment the targets comprises of shallow cylinders of styrofoam. The targets 9 and 10 are attached or hung on the H-shaped structure by any common attaching method. It should be noted that any easily penetrable material, such as straw or straw filled cloth or wood itself, will suffice as target, material. Once the missile contacts the target it will penetrate it and then become firmly imbeded in the targets 9 or 10 respectively, while at the same time the missile may be easily removed manually by a reverse pull on the missile from the target.

Additionally angle supports 11 and 12 respectively are attached at approximately the mid point of the vertical supports 25 and 26 respectively of the H-shaped structure 7 at points 13 and 14 as seen in FIG. I. Said angle supports 11 and 12 supply the support needed to maintain the H-shaped structure 7 in a vertical position, when it receives the thrust of the missile 15 as it penetrates the targets 9 or 10.

The missile 15 is constructed with a pointed end 16 and a notched end 17. The pointed end 16 is to engage the target 9 or 10 and the notched end 17 is to engage the elastic members 4 and 4′ indirectly by means of the small diameter fiber rope 6.

The operation of the present invention consists of placing the missile support and propelling means 1 at a distance from the target and target support means 7. The position of the H-shaped structures 1 and 7 respectively will be parallel to each other with the angle supports 2, 3 and 11, 12 counter to each other respectively so that angle supports 2 and 3 will support the expansion of elastic members 4, and 4′ and angle supports 11 and 12 can support the impact of the missile 15 as it strikes targets 9 or 10, as illustrated in FIG. 1.

The lower ends of each H-shaped structure 1 and 7 respectively are pointed so they may be positioned into the earth so as to secure the structure from movement during its operation.

Figure 2:
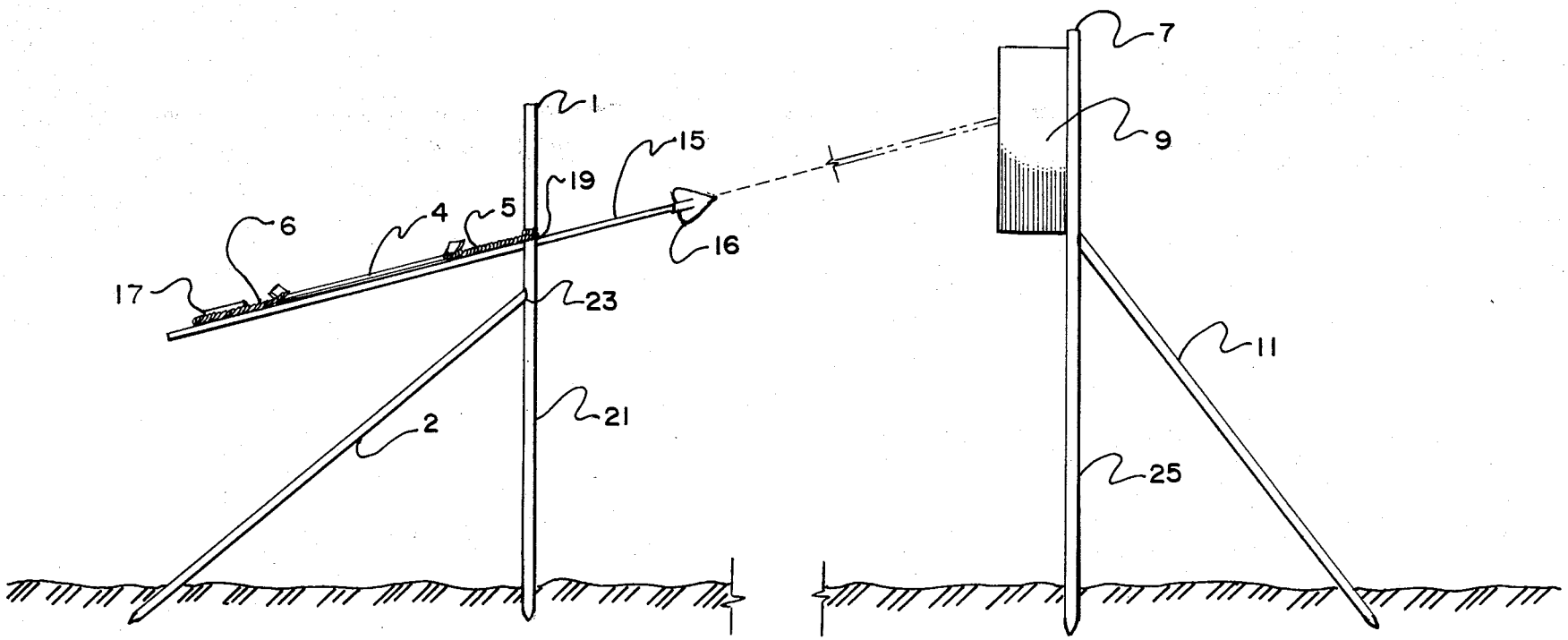
FIG. 2 is a side view illustrating the missile support and propelling mechanism as well as the target and target support structure.
Figure 3:
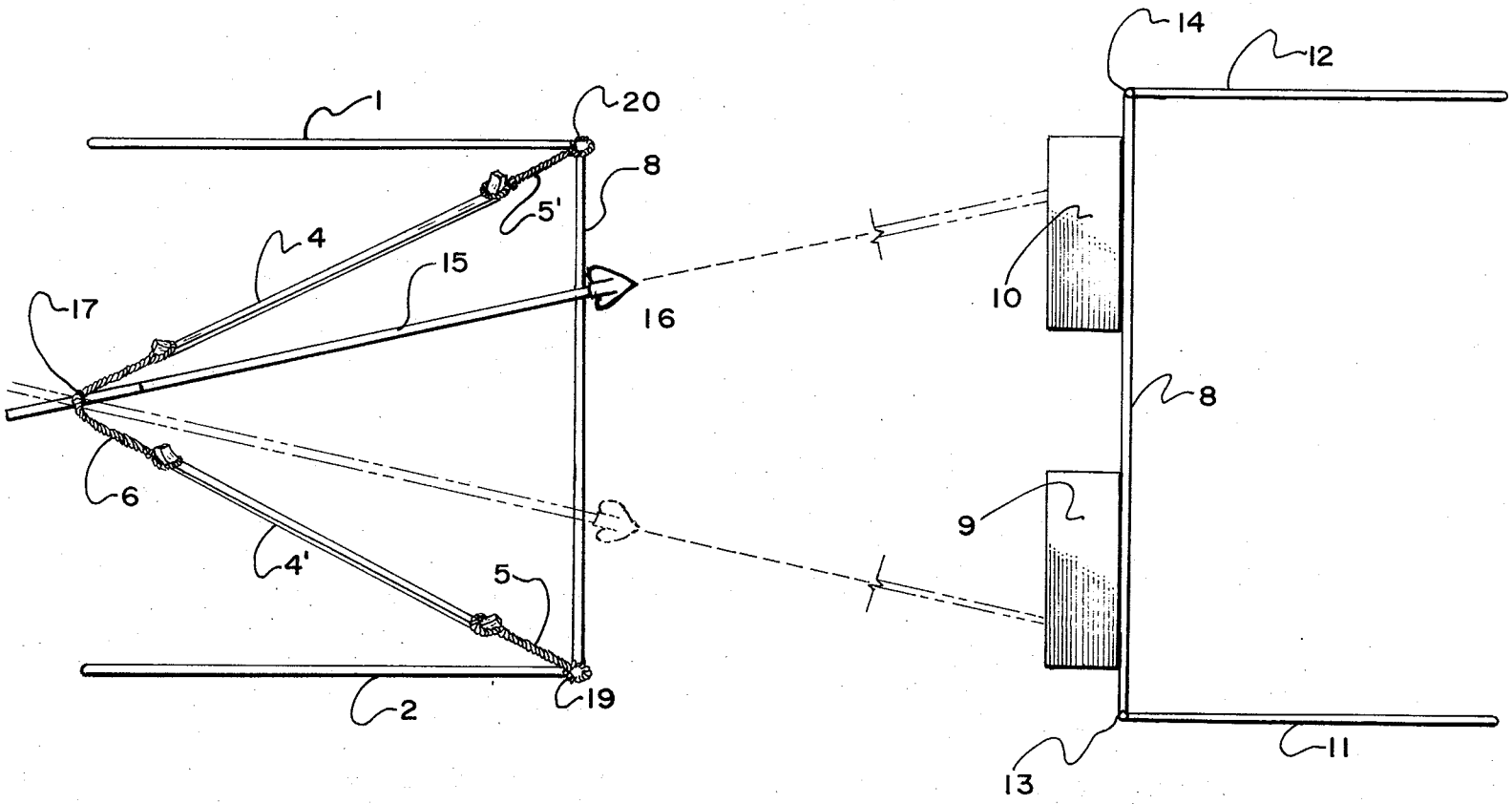
FIG. 3 is a top view illustrating the missile support mechanism and the flexibility of moving the missile in a lateral position along the support bar.

The structural members of the H-shaped structure 1 and 7 as well as the angle supports 2, 3 and 11, 12 respectively are of sufficiently small diameter and pointed so as to allow penetration of the lower ends into the earth (note FIG. 2).

It should be noted that any means of attaching the H-shaped structures 1 and 7 to earth or floor or other level or unlevel surface will suffice.

The distance that said H-shaped structures 1 and 7 are to be placed with respect to each other are limited only by the range of the missile as determined by the power of the elastic members 4 and 4′.

With the H-shaped structures 1 and 7 firmly in position and at the desired distance from each other the missile 15 can be placed on the horizontal support bar 18 at any desired point between the ends 19 and 20 respectively.

The notched element 17 of the missile 15 can be positioned against the small diameter fiber rope 6 and the missile manually pulled into the backward direction so as to expand the elastic propelling means 4 and 4′. It should be noted that means other than manual ones could be employed to expand the elastic means, for example a winch and trigger mechanism.

The point 16 of the missile 15 is provided so as to penetrate targets 9 or 10 and embed the missile therein, assuming the operator hits the targets 9 or 10.

The manual pull can vary in elevation so as to effectuate the desired path of the missile 15. The object of course is to cause an immediate release of the missile 15 from the expanded elastic position, thereby allowing the elastic members 4 and 4′ to contract, thereby forcing the missile in the direction of the targets 9 or 10, hopefully contacting either target 9 or 10 and imbeding itself into said target.

The next step is to withdraw the missile 15 from target 9 or 10 or retrieve it if the operator missed both targets 9 or 10 and proceed with another shot.

Of course, more than one missile 15 can be employed as well as more than one operator 28.

Because of the many varying and different embodiments that may be made within the scope of the inventive concept herein taught and because many modifications may be made in the embodiment herein detailed in accordance with the descriptive requirements of the law. It is to be understood that the details herein are to be interpreted as illustrative and not in a limiting sense.

What is claimed is:

1. A missile and target toy including
a target;
target support means for mounting and supporting said target;
a missile; and
stationary, missile propelling means for aiming and propelling said missile at said target, said stationary, missile propelling means comprising:
an H-shaped structure having at least two generally vertically disposed legs separated from each other a substantial distance and a missile support bar for said missile supported by said legs but below their uppermost extremity in at least a generally horizontal disposition between said legs, the lower tip of each of said legs penetrating the ground, angle support leg means attached to said H-shaped structure emanating down and back away from the direction of said target, said missile support bar at its central portion being straight, undeviated and free of any obstructions projecting above its upper surface and of any indentations extending below its upper surface for a substantial distance along its length, the missile being rested on said upper surface for aiming and propelling thereof by said means and being free to be moved laterally on said central portion a substantial distance along the straight, undeviated and free portion of said bar, allowing great freedom and latitude in the aiming and positioning of said missile with respect to the center portion of said bar.

2. The toy of claim 1 wherein the bar is free and undeviated completely across its length from leg to leg.

3. The toy of claim 1 wherein said means further comprises
elastic band means, each end thereof attached to said legs above said bar, for propelling said missile, said missile including engaging means at its rear portion for engaging said elastic band means.

* * * * *